US005507167A

United States Patent [19]

Statezni et al.

[11] Patent Number: 5,507,167

[45] Date of Patent: Apr. 16, 1996

[54] PROCESS AND DEVICE FOR PROVIDING A SHAFT WITH SPLINES

[75] Inventors: Horst Statezni; Peter Fuhrman, both of Lohmar, Germany

[73] Assignee: GKN Automotive AG, Germany

[21] Appl. No.: 234,256

[22] Filed: Apr. 28, 1994

[30] Foreign Application Priority Data

Apr. 27, 1993 [DE] Germany ..... 43 13 712.1

[51] Int. Cl.[6] ..... B21J 13/02

[52] U.S. Cl. ..... 72/355.6; 72/353.2; 72/355.2

[58] Field of Search ..... 72/343, 345, 353.2, 72/354.6, 354.8, 355.2, 355.4, 355.6

[56] References Cited

U.S. PATENT DOCUMENTS

| | | | |
|---|---|---|---|
| 3,899,912 | 8/1975 | Orain | 72/355.4 |
| 5,119,663 | 6/1992 | Bottger | 72/353.2 |

FOREIGN PATENT DOCUMENTS

| | | | |
|---|---|---|---|
| 2212767B2 | 9/1976 | Germany . | |
| 150427 | 6/1989 | Japan | 72/355.2 |
| 317653 | 12/1989 | Japan | 72/354.8 |
| 3-5039 | 1/1991 | Japan . | |
| 3-165947 | 7/1991 | Japan . | |
| 4-71747 | 3/1992 | Japan . | |
| 5-138284 | 6/1993 | Japan . | |

*Primary Examiner*—Lowell A. Larson
*Attorney, Agent, or Firm*—Harness, Dickey & Pierce

[57] ABSTRACT

A forming process for providing a shaft with splines in that the shaft is provided with splines in such a way that the complete tooth depth is ensured over the entire length to be provided with teeth and any distortions which may occur are minimized in the course of the pressing operation undertaken to provide the teeth. The forming process includes a second force directed against the operational force which is applied to the free end of the toothed shaft.

18 Claims, 5 Drawing Sheets

PROCESS AND DEVICE FOR PROVIDING A SHAFT WITH SPLINES

FIELD OF THE INVENTION

The present invention relates to a process and a device for manufacturing shafts. In particular, the present invention relates to a process and a device for providing a shaft with splines by carrying out a pressing operation.

BACKGROUND AND SUMMARY OF THE INVENTION

The process of producing radially outwardly pointing teeth or ribs on shafts by using drawing dies is known (DE-AS 2212767).

The problems involved in completely filling the die grooves with material are to be solved in that, in the running-in part of the die, the distance between the groove base and the longitudinal axis of the die is to be increased towards the running-in part, and, if necessary, an increase in the groove width is envisaged as well.

However, experience has shown that the means as proposed do not succeed in completely filling the grooves of the drawing die with material, so that the teeth are slightly inclined inwardly towards the shaft end, i.e. they comprise a reduced tip circle diameter.

At the same time, it is disadvantageous in that distortions may occur even if the axes of the tool and workpiece are aligned.

It is the object of the present invention to design the drawing process and drawing device in such a way that the intended tooth shaped and tooth profile are maintained along the entire length of the tooth to be produced and that any shaft distortions along the axial length are eliminated.

In accordance with the present invention, the objective is achieved in that the shaft is pressed by an actuating force through a drawing die provided with a profile corresponding to the splines to be provided or the shaft, while at the same time subjecting the free end of the shaft to a counter-force which is lower than the actuating force.

By applying the counter-force, it is possible to prevent the free material flow at the shaft end. As a result, the drawing die grooves determining the tooth profile are filled completely, and the drawing operation does not lead to distortion of the shaft to be provided with teeth.

According to an advantageous feature of the present invention, it is proposed that the shaft is pressed through the drawing die by a hydraulically loaded first punch and that a second punch whose diameter is smaller than the envelope circle of the profile of the drawing die passes through the drawing die in the starting position and subjects it to a counter-force.

As the second punch applies the counter-force to the shaft in the starting position, it is ensured that the profile is produced in full along the entire shaft length to be provided with teeth.

According to a second advantageous embodiment of the present invention, the second punch is also loaded hydraulically.

In this way, the counter-force is easily adapted to the actuating force.

According to a process for simultaneously producing splines on both ends of a shaft it is proposed that both ends of the shaft are simultaneously provided with splines, the counter-forge being applied to the two ends of the shaft via second punches arranged on both sides of the shaft and passing through the drawing die associated therewith in each case.

In the case of a device used for carrying out the process, it is proposed that the drawing die is held in a receiving bushing and that the second punch is guided in a guiding bushing held in the receiving means, the second punch, while passing through the drawing die in the starting position, being held by the counter-force.

In the case of a device for carrying out the process of simultaneously producing splines on both ends of a shaft it is proposed that in the horizontal position, the shaft is held by a clamping device and that drawing dies arranged on either side of the shaft may be pressed horizontally against the ends of the shaft by an actuating force adapted to the forming pressure required in each case, with two second punches applying the counter-force being arranged so as to centrally pass through the drawing die.

As a result of the shaft being received centrally in a clamping device, it is also possible to use the process in accordance with the present invention for producing different profiles requiring different actuating forces.

BRIEF DESCRIPTION OF THE DRAWINGS

Below, the present invention is explained in greater detail with reference to embodiments illustrated in the drawings wherein.

Figure 1:
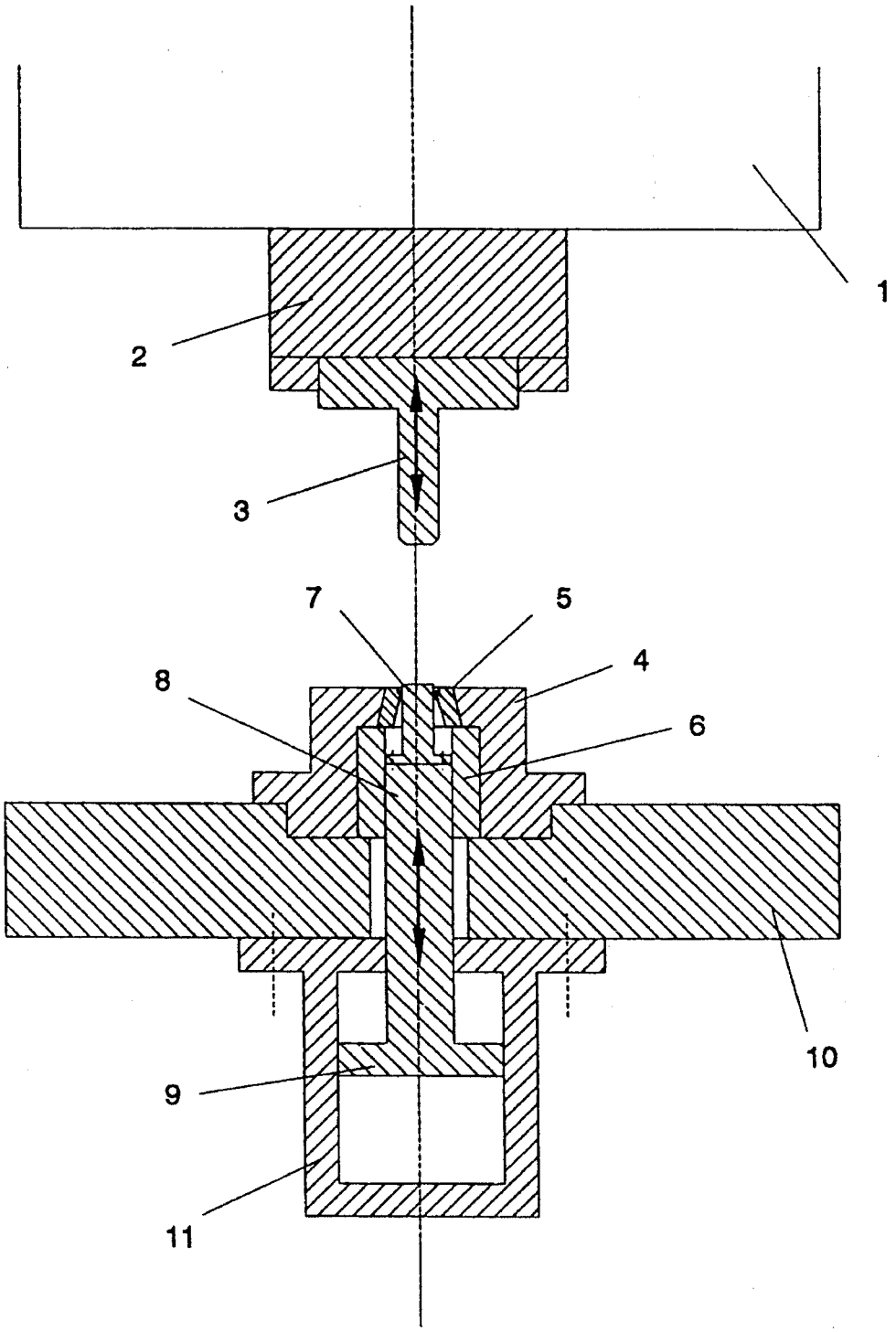
FIG. 1 is a complete view of the device for carrying out the process in accordance with the present invention.

The device provided for carrying out the process and illustrated in FIG. 1 substantially consists of the main cylinder 1 into which there is integrated a first punch 2 which, in turn, receives a shaft 3 or the workpiece. The drawing die 5 is held in a receiving bushing 4 in the lower part of the tool which includes a tensioning plate 10. Relative to the axial pressing forces, the drawing die 5 is supported via a guiding bushing 6 against the tensioning plate 10. The interior of the guiding bushing 6 contains the second punch 7 which, via receiving means 8, is connected to the piston 9 for the second punch 7. A cylinder 11 serves to apply the counter-force via a correspondingly set hydraulic pressure.

In the starting position, the second punch 7 is held so as to pass through the drawing die 5. In this way it is ensured that from the beginning of the forming operation, the availability of the counter-force required for providing the shaft 3 with teeth is ensured.

Figure 2:
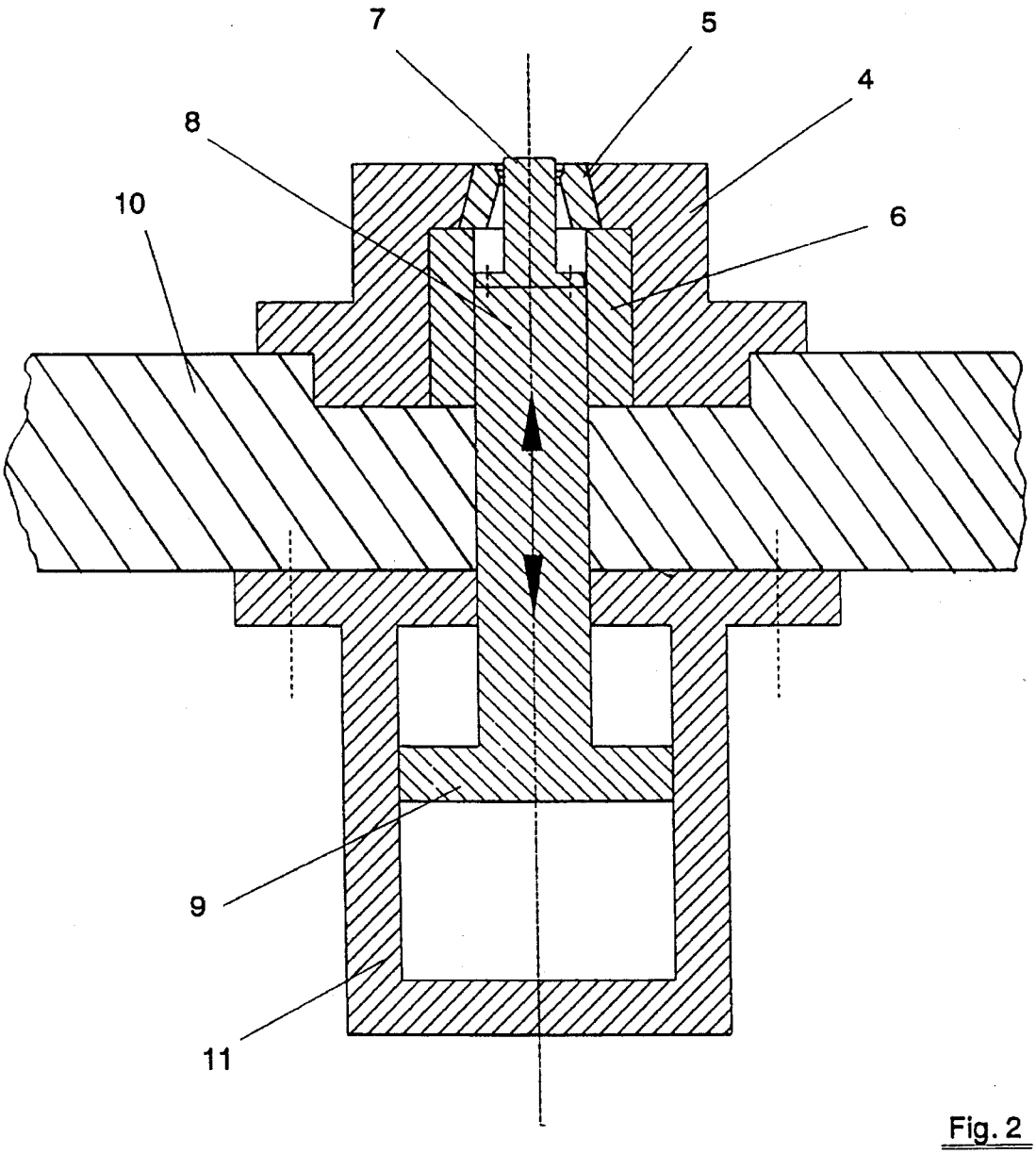
FIG. 2 shows the second punch applying the counter-force, including a hydraulic actuating device.

FIG. 2 is an enlarged illustration of the tensioning plate 10 or lower part of the tool, showing the second punch 7 passing through the drawing die 5.

Figure 3:
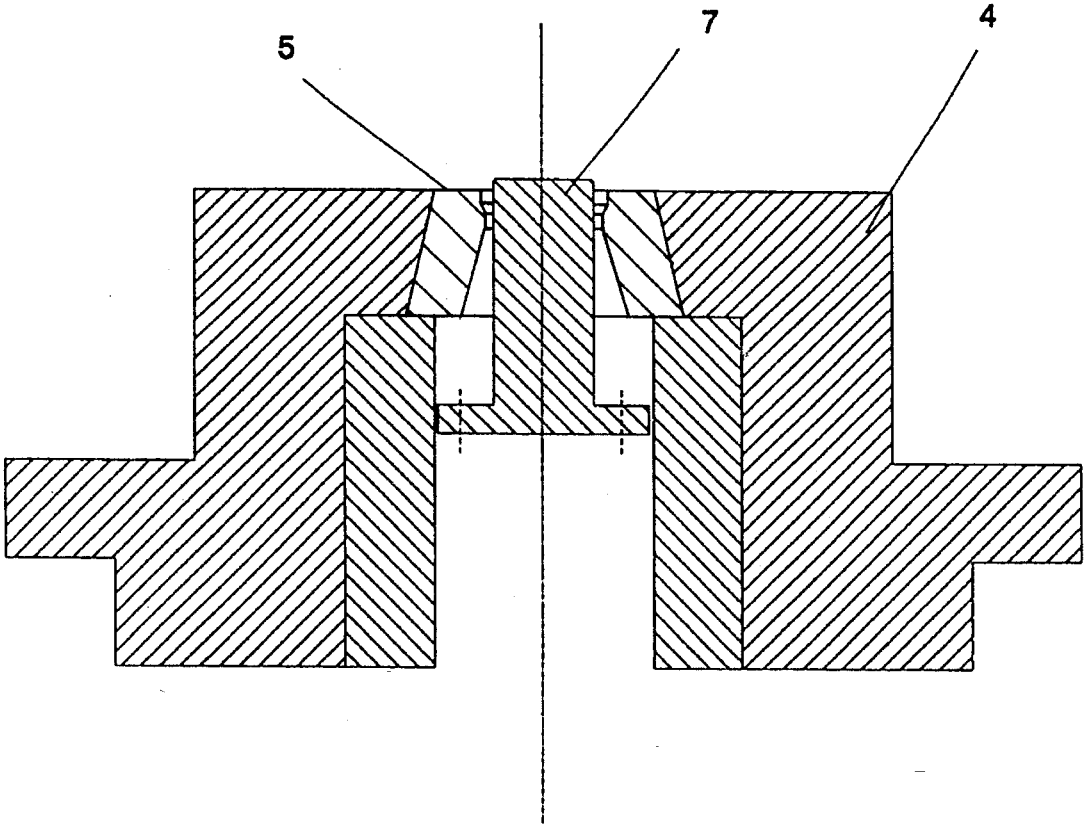
FIG. 3 shows the starting position of the second punch applying the counter-force, in the die.

FIG. 3 is an enlarged illustration showing the way in which the second punch 7 is held inside the drawing die 5 in the starting position.

Figure 4:
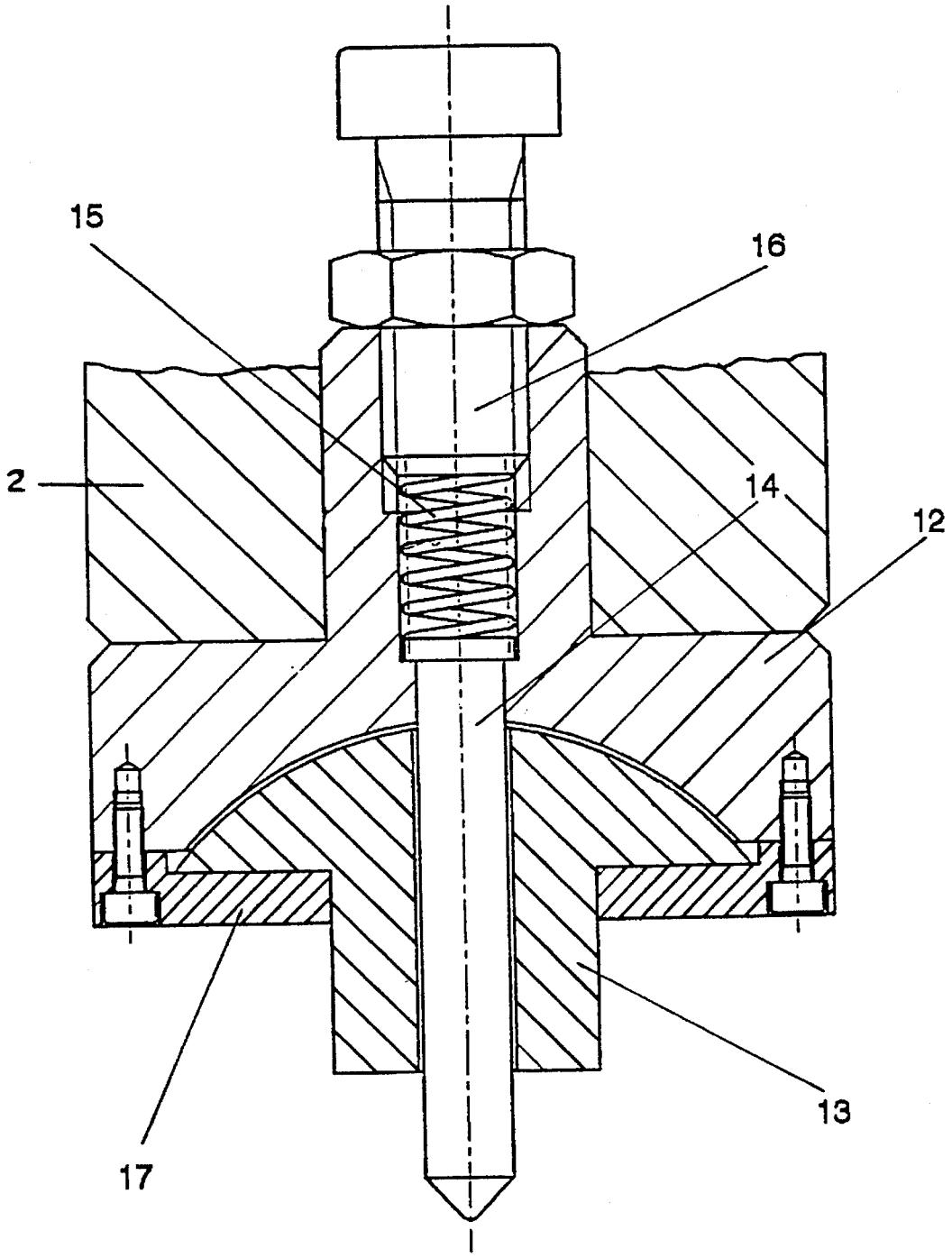
FIG. 4 shows centering receiving means arranged in the first punch and provided for centering the shaft to be machined.

FIG. 4 shows a centering head 12 for receiving the shaft 3, as associated with the first punch 2. The centering head comprises a centering pin 14 which is loaded by a spring 15, which is guided in the centering head 12 via a close fit and comprises play in the centering insert 13.

The force of the spring 15 is adaptable to the respective conditions via an adjusting screw 16.

At its end facing the centering insert 13, the centering head 12 comprises a spherical surface opposite which there is arranged a corresponding face on the centering insert 13. As a result of the latter and because the centering pin 14 is held with play in the centering insert 13, it is possible for the centering insert 13 to adjust itself to the respective upper contact face of the shaft 3.

Figure 5:
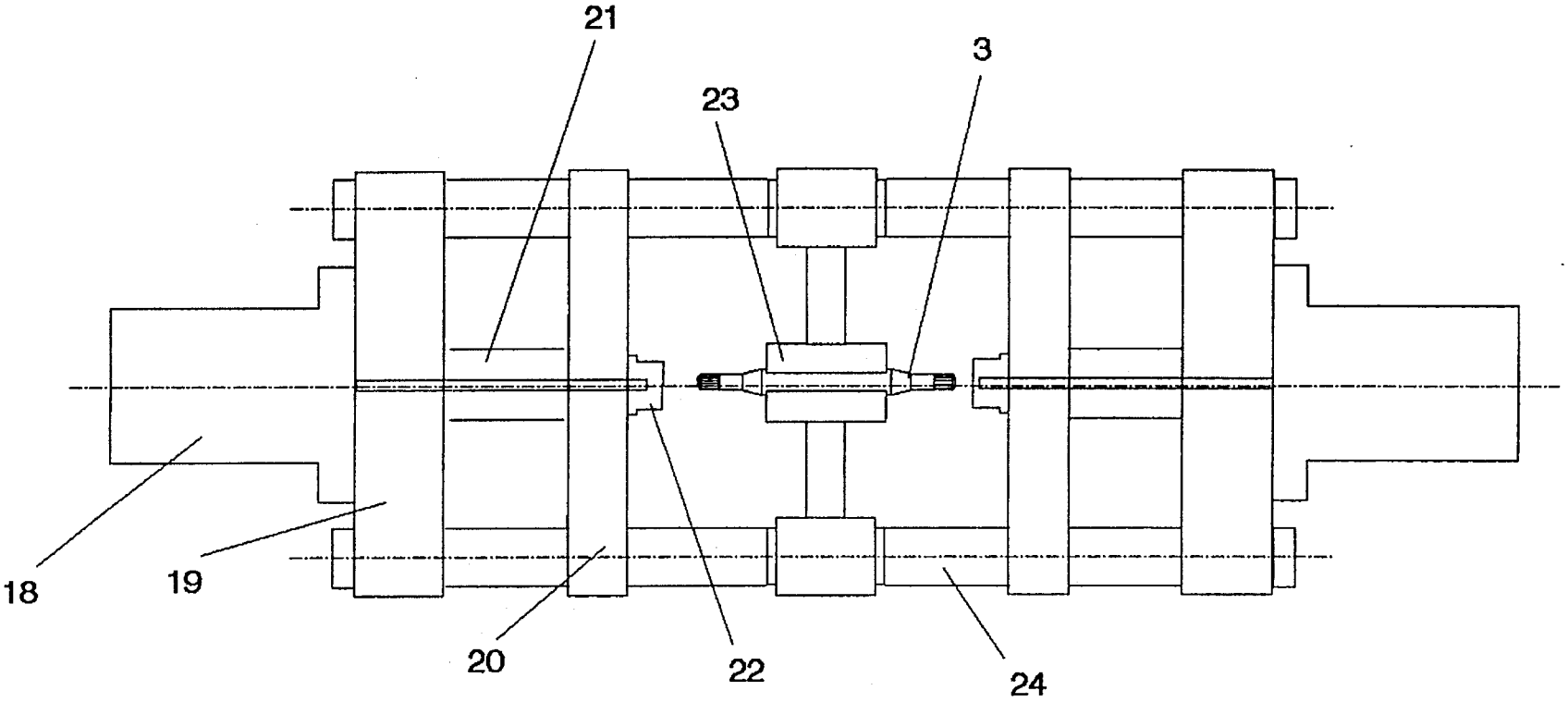
FIG. 5 shows a device for producing teeth at both ends of a shaft.

FIG. 5 shows a device for simultaneously producing splines at both ends of a shaft 30. The device is designed as a double station and substantially consists of a clamping device 23 horizontally receiving the shaft 30. The hydraulic cylinders 18 apply the actuating force required at both ends via hollow piston rods 21. The second punches 7 passing through the drawing dies 5 held in receiving means 22 are arranged in the interior of the hollow piston rods 21. The receiving means for the drawing dies 5 are secured to a cross bar 20 displaceable by the hollow piston rod 21. The hydraulic cylinders 18 are held by cross bars 19 secured via a column guiding rack 24.

The process described is suitable for both solid shafts and hollow shafts.

While the above detailed description describes the preferred embodiment of the present invention, it should be understood that the present invention is susceptible to modification, variation and alteration without deviating from the scope and fair meaning of the subjoined claims.

What is claimed is:

1. A method for forming at least one set of splines on a shaft, said method comprising the steps of:

applying a first actuating force, via a first punch, between said shaft and a first drawing die to form a first set of splines on a first end of said shaft;

contacting a second punch prior to entering said first drawing die; and applying a first counter-force to said first end of said shaft, via said second punch upon contact with said second punch, said first counter-force being lower than said first actuating force.

2. The method according to claim 1 wherein said step of applying said first actuating force comprises pressing said shaft through said first drawing die using a hydraulically loaded first punch and said step of applying said first counter-force comprises passing said second punch through said first drawing die to apply said first counter-force.

3. The method according to claim 2 wherein said second punch is loaded hydraulically.

4. The method according to claim 1 further comprising the steps of:

applying a second actuating force between said shaft and a second drawing die to form a second set of splines on a second end of said shaft;

applying a second counter-force to said second end of said shaft, said second counter-force being lower than said second actuating force.

5. The method according to claim 4 wherein said step of applying said first actuating force comprises pressing said first drawing die over said first end of said shaft using a hydraulically loaded first punch and said step of applying said first counter-force comprises passing a second punch through said first drawing die to apply said first counter-force.

6. The method according to claim 5 wherein said second punch is loaded hydraulically.

7. The method according to claim 5 wherein said step of applying said second actuating force comprises pressing said second drawing die over said second end of said shaft using a hydraulically loaded third punch and said step of applying said second counter-force comprises passing a fourth punch through said second drawing die to apply said second counter-force.

8. The method according to claim 7 wherein said fourth punch is loaded hydraulically.

9. The method according to claim 1 wherein said step of applying said first actuating force comprises pressing said first drawing die over said first end of said shaft using a hydraulically loaded first punch and said step of applying said first counter-force comprises passing a second punch through said first drawing die to apply said first counter-force.

10. The method according to claim 9 wherein said second punch is loaded hydraulically.

11. An apparatus for forming at least one set of splines on a shaft, said apparatus comprising:

a tensioning plate;

a receiving bushing secured to said tensioning plate;

a drawing die disposed within said receiving bushing;

a guiding bushing disposed within said receiving bushing; and a punch disposed within said guiding bushing, said punch capable of axial movement with respect to said guiding bushing and said drawing die such that said punch passes through said drawing die such that a workpiece contacts said punch prior to the workpiece entering said die.

12. An apparatus for forming at least one set of splines on a shaft, said apparatus comprising:

a clamping device for holding said shaft;

a first drawing die disposed at a first end of said shaft, said first drawing die capable of axial movement with respect to said shaft such that said first drawing die forms a first set of splines on said first end of said shaft upon exertion of a first actuating force; and a first punch extending through said first drawing die such that a workpiece contacts said punch prior to the workpiece entering said die, said first punch capable of exerting a first counter-force to said first end of said shaft.

13. The apparatus according to claim 12 further comprising a first hydraulic cylinder secured to said first drawing die for providing said axial movement for said first drawing die and the exertion of said first actuating force.

14. The apparatus according to claim 13 further comprising a second hydraulic cylinder secured to said first punch for exerting said first counter-force.

15. The apparatus according to claim 14 further comprising:

a second drawing die disposed at a second end of said shaft, said second drawing die capable of axial movement with respect to said shaft such that said second drawing die forms a second set of splines on said second end of said shaft upon exertion of a second actuating force; and a second punch extending through said second drawing die, said second punch capable of exerting a second counter-force to said second end of said shaft.

16. The apparatus according to claim 15 further comprising a third hydraulic cylinder secured to said second drawing die for providing said axial movement for said second drawing die and the exertion of said second actuating force.

17. The apparatus according to claim 16 further comprising a fourth hydraulic cylinder secured to said second punch for exerting said second counter-force.

18. The apparatus according to claim 12 further comprising:

a second drawing die disposed at a second end of said shaft, said second drawing die capable of axial movement with respect to said shaft such that said second drawing die forms a second set of splines on said second end of said shaft upon exertion of a second actuating force; and a second punch extending through said second drawing die, said second punch capable of exerting a second counter force to said second end of said shaft.

* * * * *